United States Patent [19]

Yamane

[11] Patent Number: 4,582,006

[45] Date of Patent: Apr. 15, 1986

[54] AUTOMATIC SEWING MACHINE

[75] Inventor: Iwao Yamane, Aichi, Japan

[73] Assignee: Mitsubishi Denki Kabushiki Kaisha, Tokyo, Japan

[21] Appl. No.: 604,275

[22] Filed: Apr. 26, 1984

[30] Foreign Application Priority Data

Apr. 28, 1983 [JP] Japan ..... 58-75124

[51] Int. Cl.[4] ..... D05B 21/00

[52] U.S. Cl. ..... 112/121.12; 112/275

[58] Field of Search ..... 112/121.12, 121.11, 112/158 E, 275, 277, 453, 456

[56] References Cited

U.S. PATENT DOCUMENTS 4,135,459 1/1979 Manabe et al. ..... 112/121.12

4,221,176 9/1980 Besore et al. ..... 112/121.12

*Primary Examiner*—Peter Nerbun

*Attorney, Agent, or Firm*—Sughrue, Mion, Zinn, Macpeak and Seas

[57] ABSTRACT

An automatic sewing machine including a sewing machine mechanism head for foaming a seam (switch pattern) on a web, a web presser for pressing the web, a driving mechanism for moving the web presser along X and Y axes in accordance with a predetermined pattern, and a control device for controlling each of the above, wherein the control device determines the start position of sewing at a fixed initial position or another designated position within a sewing area in accordance with the setting of a switch. The start position of the seam pattern may be selected in accordance with the formation of the seam pattern and properties of the web to achieve a highly efficient sewing operation.

4 Claims, 7 Drawing Figures

AUTOMATIC SEWING MACHINE

BACKGROUND OF THE INVENTION

The present invention relates to an automatic sewing machine, particularly, to an automatic sewing machine in which a presser device holding the web, such as the cloth to be sewn, is automatically moved in accordance with a predetermined pattern thereby to form a seam (stitched pattern) in a predetermined manner.

In a conventional automatic sewing machine, seam pattern data is read out from pattern data memories under the control of a central processing unit (CPU), the read-out data is applied to a pulse train generating circuit to generate pulses in a number corresponding to the amount of web to be fed in synchronism with the rotation of the sewing machine, and the pulses are applied to a web feed driving mechanism to move a web presser connected to the web feed driving mechanism by a predetermined amount, thereby to form the seam pattern on the web on the basis of the seam pattern data.

According to such an automatic sewing machine, when the CPU detects the termination of a sewing operation, the CPU stops the read-out operation of the seam pattern data from the seam pattern data memory and actuates an oscillation circuit within the pulse train generating circuit to generate a continuous pulse stream, which is applied to the web feed driving mechanism thereby to return the web presser to a predetermined initial position thereof. Therefore, in the conventional control apparatus, the initial position and the end position for sewing are the same, regardless of the seam pattern data. Consequently, such a conventional control apparatus has an advantage that a fault in the sewing pattern can be detected at once, even if the seam pattern is shifted, such as may be due to a malfunction of the pulse motor in the web feed driving mechanism. On the other hand, the conventional control apparatus has a disadvantage that, in the case where there is a shift between the seam pattern and the web as fixed by the web presser frame prior to the start of sewing, it is very difficult to obtain accurate adjustment of the web presser in accordance with the seam pattern. Further, if the actual position is displaced from the desired initial position, time is required for moving the web presser frame to the desired initial position, thereby reducing the production performance.

SUMMARY OF THE INVENTION

An object of the present invention is thus to provide an automatic sewing machine in which the start position of a seam pattern can be set at the conventional fixed initial position or any chosen position within the sewing area.

To achieve the above object, the automatic sewing machine of the present invention provides a sewing machine mechanism for forming a seam on a web, a web presser for pressing the web, a driving mechanism for moving the web presser along X and Y axes in accordance with a predetermined pattern, and control means for controlling each of the above, wherein the control means sets the start position of sewing either at a fixed initial position or a designated position within the sewing area with the choice being made by operation of switching means.

BRIEF DESCRIPTION OF THE DRAWINGS

The above and other objects, features and advantages of the present invention will be more clear from the following description taken with reference to the accompanying drawings, in which.

DESCRIPTION OF THE PREFERRED EMBODIMENTS

Figure 1:
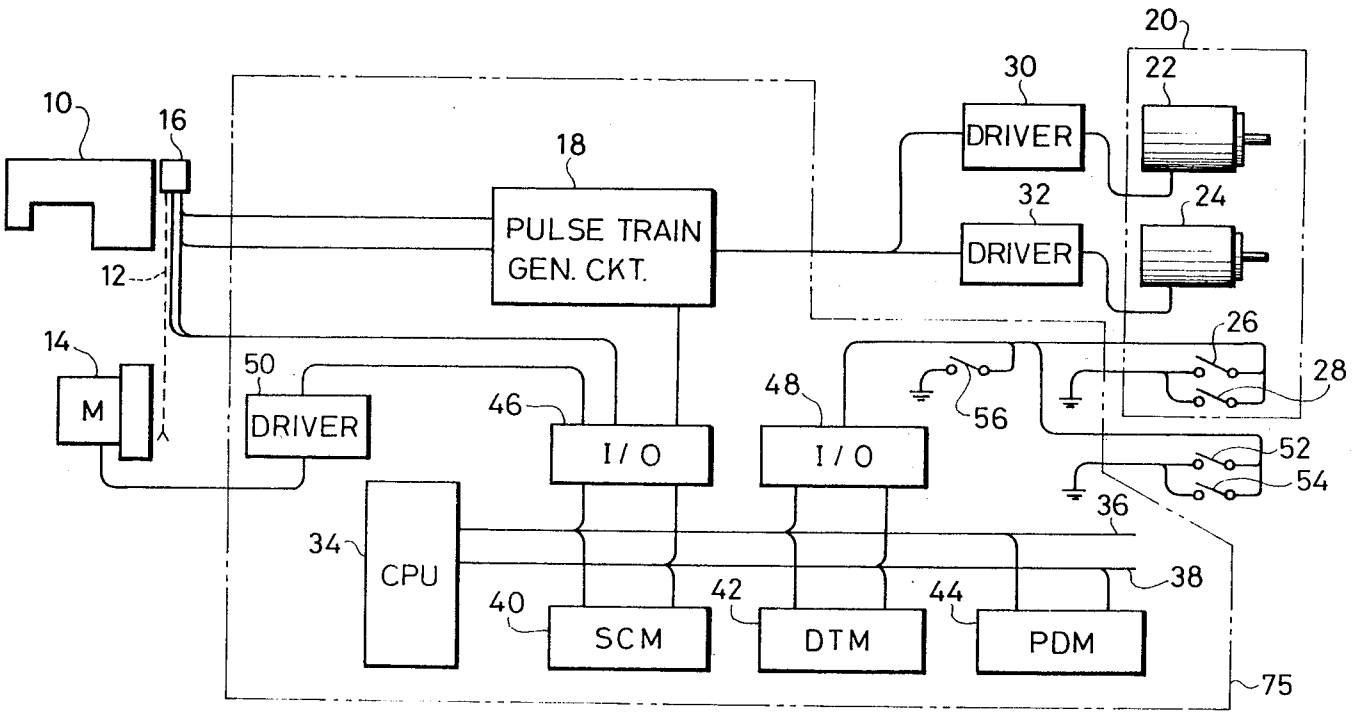
FIG. 1 is a block diagram showing the overall construction of an automatic sewing machine of the present invention.

A preferred embodiment of the present invention will now be described in detail. FIG. 1 is a block diagram of the overall construction of an automatic sewing machine of the invention. As is apparent from the drawing, the rotational driving force of a motor 14 is transmitted to the upper drive shaft (not shown) of the head 10 of an automatic sewing machine through a drive force transmitting member 12 such as a belt. There is provided on the upper drive shaft a detector 16 for generating pulses in accordance with upper and lower needle position signals. The detector 16 is connected to a web feed pulse train generating circuit 18 in a control device 75 (explained hereinafter), and an input and output port 46 (also explained hereinafter). A driving mechanism 20 for X and Y axes is composed of pulse motors 22, 24 for driving a web presser in orthogonal X and Y directions, and switches 26 and 28 which detect initial positions on the X and Y axes, respectively, connected in parallel. The output side of the web feed pulse train generating circuit 18 is connected to drivers 30 and 32 for driving the motors 22 and 24, respectively. A central processing unit (CPU) 34 has a data bus 36 and an address bus 38 connected to a system control member (SCM) 40, a data temporal memory (DTM) 42, a pattern data memory (PDM) 44, and input/output ports 46 and 48 for the data. The input/output port 46 is connected to the detector 16, the web feed pulse train generating circuit 18, and the driver 50 for driving the motor 14. Further, the input/output port 48 is connected to the initial position detecting switches 26 and 28, an operation starting switch 52, and a switch 54 for moving the web presser upward and downward. Reference numeral 56 denotes a switch used for selecting the starting position for sewing, which is connected to the output side of the input/output port 48.

Figure 2:
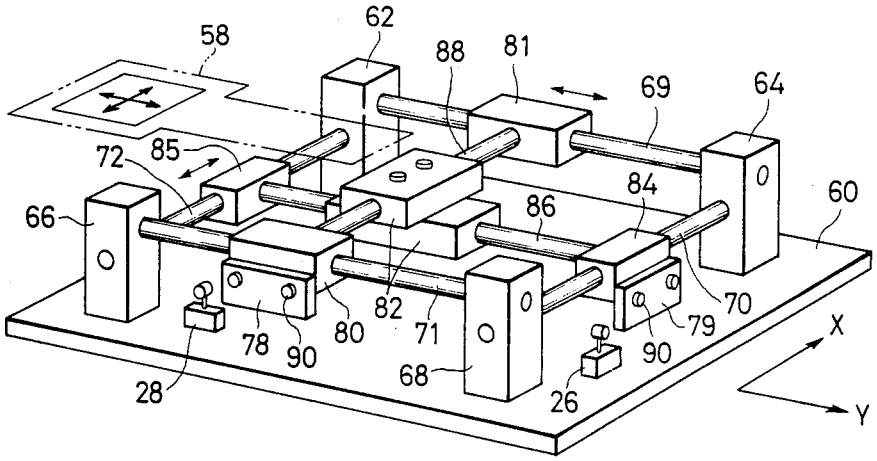
FIG. 2 is a perspective view showing a driving mechanism used in the automatic sewing machine of the invention.

Referring to FIG. 2, the driving mechanism 20 will now be explained. The driving mechanism 20 is positioned at the lower portion of the head 10 of the automatic sewing machine shown in FIG. 1. In FIG. 2, reference numeral 60 denotes a table base; 62, 64, 66 and 68, supporting posts mounted on the table base; 69 to 72, supporting shafts; 80 and 81, Y sliders slidably mounted on the supporting shafts 71 and 69 and slidable in the direction of the Y axis; 84 and 85, X sliders slidably mounted on the supporting shafts 70 and 72 and slidable in the direction of the X axis; and 82, sliders connected to the X sliders 84 and 85 and the Y sliders 80 and 81 through the shafts 86 and 88, respectively, and moved in the directions X and Y axes in accordance with the movements of the X sliders 84 and 85 and the Y sliders 80 and 81. Reference numeral 58 denotes a web pressing device for pressing and moving the web to be sewed, one end of which is fixed on the upper surface of the slider 82 and the other end of which has a web presser frame 59. The web pressing device is adapted to control the web presser frame 59 to open and close via a driving mechanism (not shown) in accordance with the energization and deenergization of the switch 54. Reference numerals 78 and 79 denote dogs fixed to the X slider 84 and the Y slider 80 by screws 90. When the X and Y sliders 84 and 80 reach a predetermined position, the dogs 78 and 79 abut the initial position detecting switches 26 and 28 mounted on the table base 60, setting them to the ON state. The X sliders 84 and 85 and the Y sliders 80 and 81 are adapted to be moved by the pulse motors 22 and 24.

Figure 3:
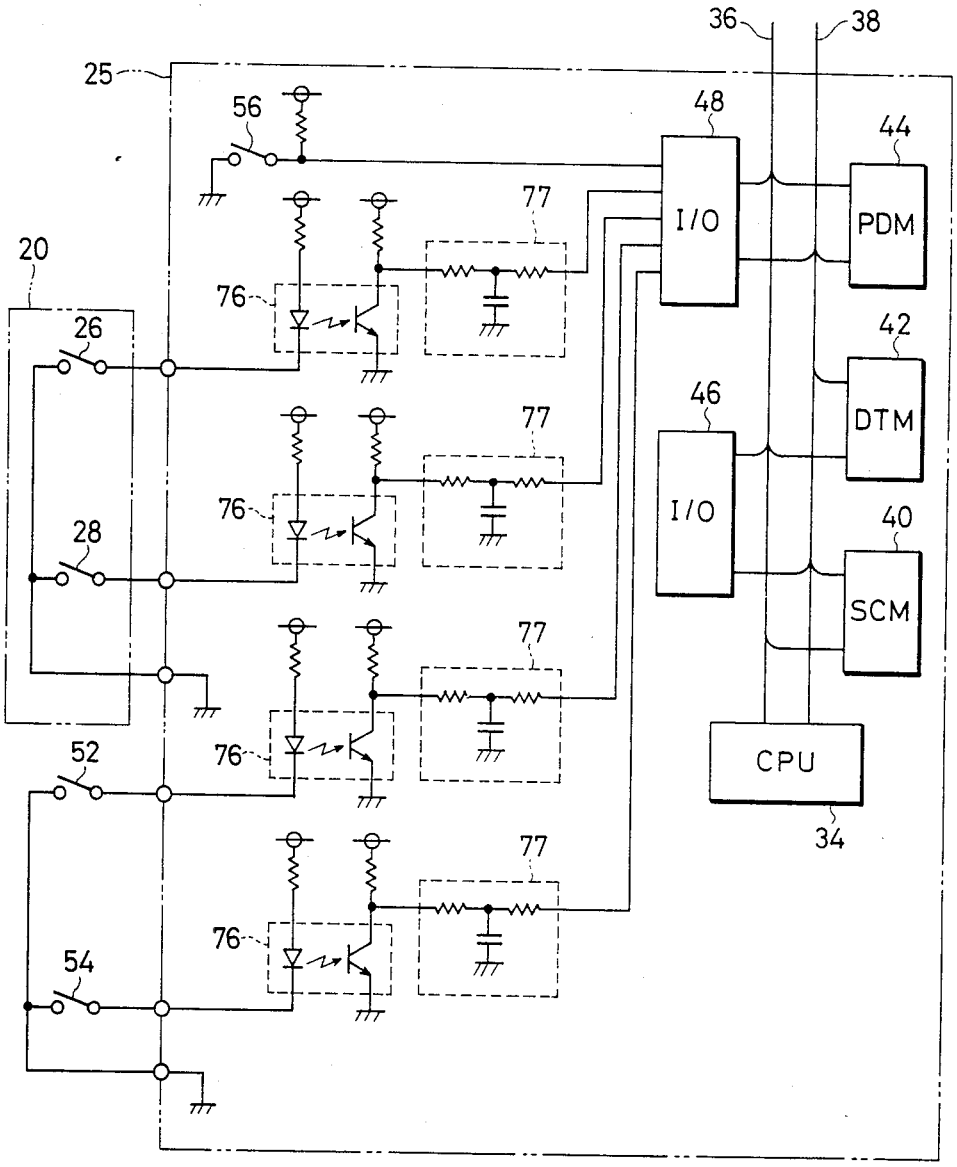
FIG. 3 is a circuit diagram of a control circuit of the invention.

Referring now to FIG. 3, the detailed construction of the control device 75 is shown. In FIG. 3, reference numerals 76 and 77 denote a photo-interrupter and a filter circuit, respectively. The remaining components are the same as shown in FIGS. 1 and 2.

In the OFF state of the switch 56, a high-level signal H is read into the CPU 34 through the input and output port 48, while in the ON state of the switch 56, a low-level signal L is read into the CPU 34. Similarly, signals H and L are read into the CPU 34 through the photointerrupter 76, the filter circuit 77 and the input/output port 48 by each of the switches 26, 28, 52 and 54.

Figure 4:
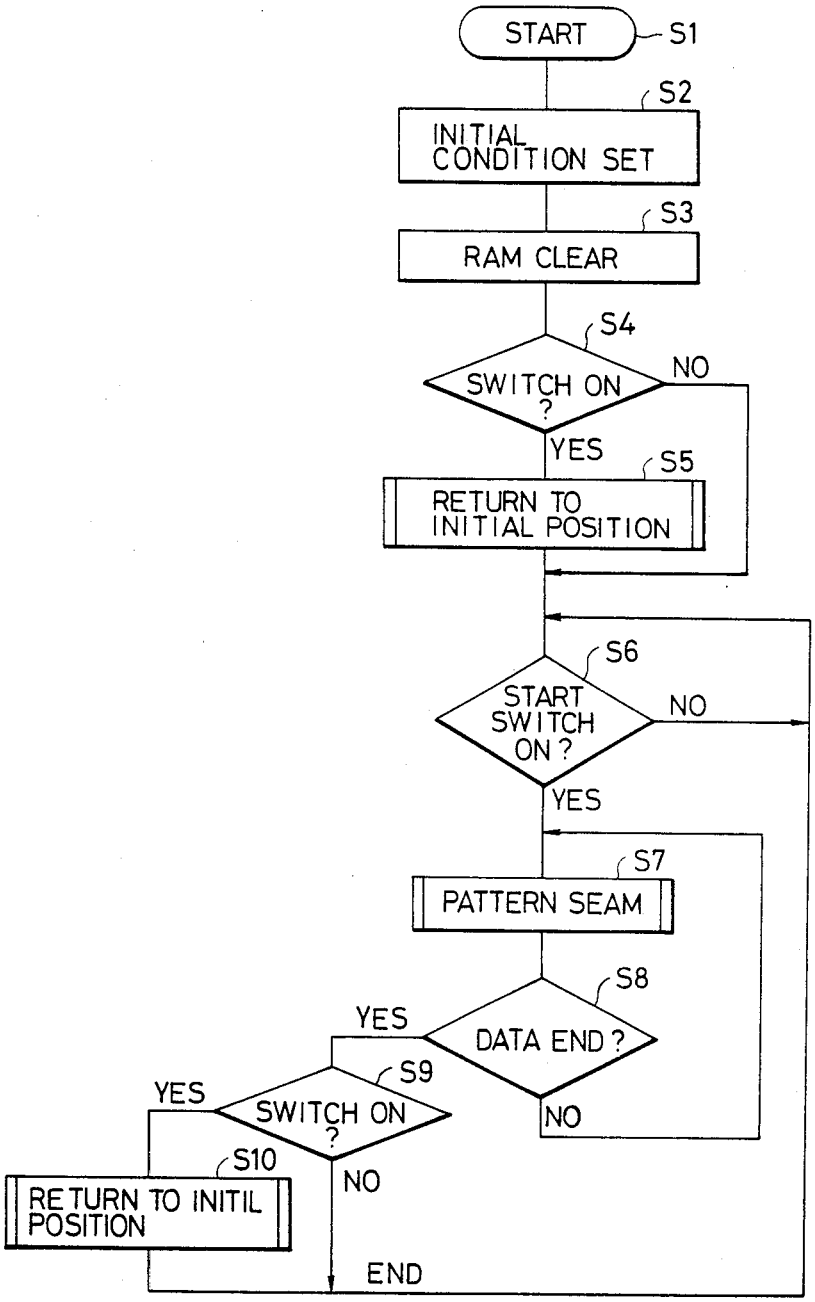
FIG. 4 is a flowchart showing the operation of the control circuit.

Referring to FIG. 4, a flowchart is shown with which is indicated the operation to determine whether the start position of the seam pattern should be at the fixed initial position or another designated position within the sewing area in accordance with the ON or OFF state of the switch 56.

Figure 5:
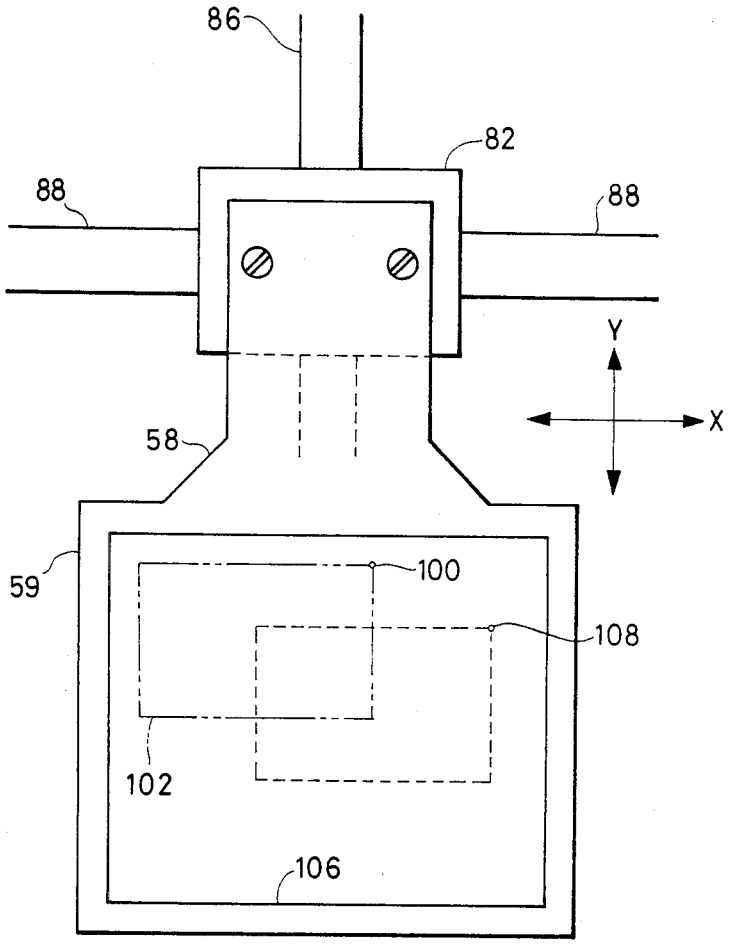
FIG. 5 is a plan view showing the interelationship among a web presser, a seam pattern, and the start position of the seam pattern.

Referring to FIG. 5 the interrelationship among the web presser frame 59, the seam pattern and the start position of the seam pattern is depicted. As mentioned above, the web presser frame 59 for pressing the web is fixed on the slider 82. In FIG. 5, a solid line inside the web presser frame 59 shows the sewing area 106, a dotted line in the sewing area shows the fixed initial position 108 and the designated position 100, and a two-dot chain line shows the seam pattern 102. Each of the positions 108 and 100 corresponds to the position of the head 10 of the sewing machine at which the needle is to be inserted through the web.

The control operation for the automatic sewing machine employing the control device thus constructed will be explained hereinafter. Upon the closure of the switch 54, the web presser frame 59 is lowered to press the web. Then, upon the closure of the sewing machine starting switch 52, the CPU 34 drives the sewing machine driver 50 through the input/output port 46. Upon receiving the drive signal from the driver 50, the motor 14 rotates to drive the sewing machine. At that time, the CPU 34 reads the web feed data for one needle position, in synchronism with the position signal of the needle, from the memory PDM 44 storing the seam pattern data. The data is transmitted to the web feed pulse train generating circuit through the input/output port 46. The web feed pulse train generating circuit 18, upon receiving the transmitted signal, outputs pulses in a number corresponding to the length of the web to be fed to the pulse motor drivers 30 and 32 in synchronism with the rotation of the sewing machine to drive the pulse motors 22 and 24 for each axis in order to move the web presser by a predetermined feeding amount, thereto to form the desired pattern on the web on the basis of the seam pattern data stored in the memory PDM 44.

A more detailed explanation of the control operation will be given with reference back to FIG. 4. After a power switch is actuated, the control operation is started (step S1). Then, the CPU 34 sets an initial condition in accordance with the memory SCM 40 (FIG. S2), the memory DTM 42 being cleared (step S3). Next, the ON or OFF state of the switch 56 is checked (step S4). If the ON state of the switch 56 is found, the subroutine for returning to the initial position is executed (step S5) and the web presser frame 59 is moved to the predetermined initial position 108 by the initial position detecting switches 26 and 28, thereby to stop the control operation. On the other hand, if the OFF state of the switch 56 is found, the web presser frame is located to the designated position 100 without returning to the initial position.

Subsequently, upon sensing the ON state of the start switch 52 (step S6), the subroutine of the pattern seam is executed such that the CPU 34 reads the pattern data for each switch pattern from the memory PDM 44 and executes it (step S7). The control operation is next returned from the subroutine of the pattern seam to the main flow chart. At that point, it is determined whether the next pattern data contains a data end instruction (step S8). When the data end is not present, the subroutine of the pattern seam is again executed to execute the seam pattern 102. On the other hand, when a data end is present, the state of the switch 56 is checked (step S9). If the OFF state of the switch 56 is found, the seam cycle of one seam is ended, thereby returning to the step S6 for checking the state of the switch 56. If the ON state of the switch 56 is found, the subroutine of returning to the initial position is executed (step S10), and then the web presser is moved to the fixed initial position 108, stopping at that position. The control operation returns to the step S6 for checking the state of the switch 56.

Figure 6:
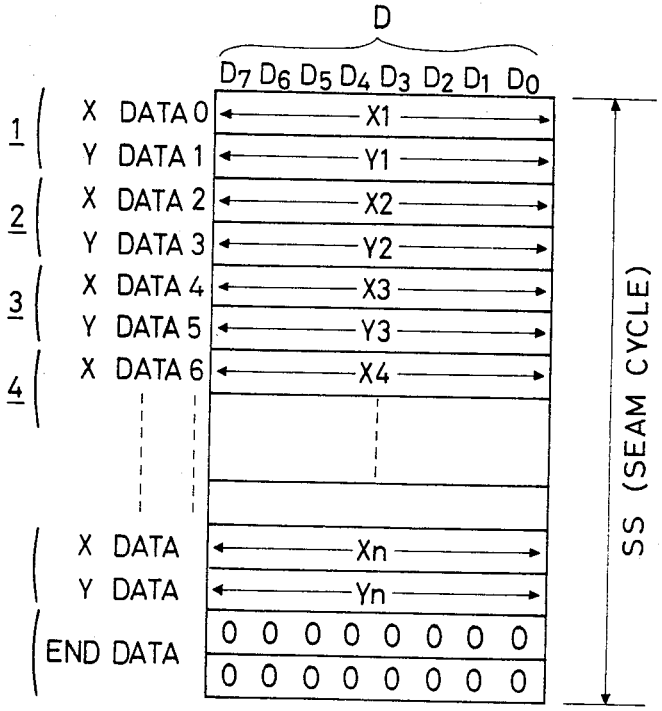
FIG. 6 shows an example of seam pattern data.
Figure 7:
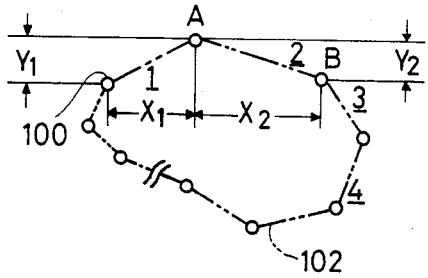
FIG. 7 is an explanatory diagram in which a single seam pattern is shown in correspondence with the data of FIG. 6.

Referring now to FIG. 6, the pattern data D stored in the memory PDM 44 is shown. One web feeding operation for one seam is effected by two bytes. One data value in the X direction includes information concerning the amount of movement and the direction of movement in the X direction. Similarly, one data value in the Y direction contains information concerning the amount of movement and the direction of movement in the Y direction. These X and Y data values are the feeding instructions for one stitch. The seam cycle SS is executed from the $X_1$ data value to the END data instruction. Therefore, in the case where the switch 56 is in the OFF state and the seam cycle is as shown in FIG. 7, the first stitch is executed from the designated position 100 to the position A, namely, the needle is moved by $X_1$ in the direction of the X axis and by $Y_1$ in the direction of the Y axis, with the data values $X_1$ and $Y_1$ being paired as shown by 1 in FIG. 6. Similarly, paired data value $X_2$ and $Y_2$, and $X_3$ and $Y_3$ are indicated by 2 and 3, respectively, in FIG. 6.

The seam cycle as shown in FIG. 7 is executed in such a manner that the needle starts from the designated initial position 100 to the same position 100 through the first seam point A, the second seam point B, etc., in accordance with the X and Y data values of FIG. 6. The END data instruction, composed of all zeros for both X and Y data values, is used to indicate to the CPU 34 the termination of the seam cycle. These are read in step S8 as shown in FIG. 4.

Next, the CPU 34 reads the state of the switch 56. For the OFF state of the switch 56, the CPU 34 terminates the present seam pattern. For this purpose, the data stored in the memory PDM 44 is programmed so as to conform the start point of the sewing to the end point of the sewing. On the other hand, for the OFF state of the switch 56, as mentioned above, the web presser frame 59 is set at the designated position 100, and hence the sewing starts from the designated position 100.

On the other hand, for the ON state of the switch 56, the CPU 34 executes the subroutine of returning to the initial position whereby the web presser frame 59 is moved until the initial position is detected by the switches 26 and 28 mounted on the driving mechanism 20 for X and Y axes, regardless of the pattern data in the memory PDM 44. When the initial position is detected by the CPU 34 by means of the switches 26 and 28, the subroutine of returning to the initial position of step S10 in FIG. 4 is completed. Therefore, the start point of sewing always is set to the predetermined initial position 108.

The seam pattern data stored in the memory PDM 44 can be such that the start point is not the same as the end point.

In brief, in either position of the switch 56, the control operation is returned to step S6 of FIG. 4 upon the completion of one seam pattern, and if the switch 56 is set again to ON, the seam cycle is repeated.

As mentioned above, according to the automatic sewing machine of the present invention, it is possible to set the start point of the seam pattern to a predetermined initial position or any other designated position. As a result, a seam cycle with high efficiency can be achieved in accordance with sewing conditions such as the seam pattern, the type of web presser, the type of fabric, and the like, thereby reducing the time required for the preparation of sewing, improving production performance remarkably.

I claim:

1. In an automatic sewing machine of a type comprising a sewing machine head for forming a seam pattern on a web, a web presser for pressing said web, a driving mechanism for moving said web presser along X and Y axes in accordance with a predetermined pattern, and control means for controlling said head, web presser and driving mechanism, the improvement wherein said control means comprises switching means and means for establishing a start position of sewing said predetermined pattern at one of a fixed initial position and an arbitrary designated position within a sewing area on said web in accordance with a switching state of said switching means.

2. The automatic sewing machine according to claim 1, wherein said switching means comprises a switch for switching the start position of said sewing, and operation processing means for establishing said start position at a chosen one of said fixed initial position and said designated position in accordance with an output signal of said switch and in accordance with a stored program.

3. The automatic sewing machine according to claim 1, wherein said control means comprises a pulse generating circuit for generating a web feed signal, and wherein said driving mechanism comprises a first pulse motor for driving said web presser in the direction of said X axis and a second pulse motor for driving said web presser in the direction of said Y axis.

4. The automatic sewing machine according to claim 1, wherein said driving mechanism comprises two switches for detecting the presence of said web presser at said fixed initial position.

* * * * *